United States Patent [19]

Holloway et al.

[11] Patent Number: 4,991,987

[45] Date of Patent: Feb. 12, 1991

[54] COSMETIC CONTAINER

[75] Inventors: Thomas F. Holloway, Southbury; Dominic Wilks, Jr., Ridgefield, both of Conn.

[73] Assignee: Risdon Corporation, Naugatuck, Conn.

[21] Appl. No.: 471,098

[22] Filed: Jan. 23, 1990

[51] Int. Cl.[5] ..... A45D 40/06; A45D 40/12

[52] U.S. Cl. ..... 401/78; 401/79; 401/87; 401/117

[58] Field of Search ..... 401/69, 78, 79, 87, 401/117, 68, 75

[56] References Cited

U.S. PATENT DOCUMENTS

| | | | |
|---|---|---|---|
| 2,797,802 | 7/1957 | Hopgood | 206/56 |
| 2,838,170 | 6/1958 | Isele | 206/56 |
| 2,840,229 | 6/1958 | Hopgood | 206/56 |
| 2,913,103 | 11/1959 | Isele | 206/56 |
| 2,999,585 | 9/1961 | Hultgren | 206/56 |
| 3,083,822 | 4/1963 | Clark | 206/56 |
| 3,091,329 | 5/1963 | Levine | 401/79 |
| 3,298,509 | 1/1967 | Hultgren | 206/56 |
| 3,317,036 | 5/1967 | Cherba | 401/78 |
| 3,335,853 | 8/1967 | Geisel | 206/56 |
| 3,511,575 | 5/1970 | Berins | 401/78 |
| 4,166,707 | 9/1979 | Zawachi et al. | 401/63 |
| 4,380,402 | 4/1983 | Andrews et al. | 401/74 |
| 4,615,632 | 10/1986 | Iwamoto et al. | 401/69 |
| 4,750,501 | 6/1988 | Ackermann et al. | 132/79 C |

FOREIGN PATENT DOCUMENTS

| | | | |
|---|---|---|---|
| 1054212 | 4/1959 | Fed. Rep. of Germany | 401/78 |
| 2291717 | 7/1976 | France | 401/78 |
| 710934 | 6/1954 | United Kingdom | 401/79 |

*Primary Examiner*—Steven A. Bratlie

*Attorney, Agent, or Firm*—St. Onge Steward Johnston & Reens

[57] ABSTRACT

An improved container for a solid cosmetic preparation is provided having a container length for containing therein a rod of cosmetic preparation mounted for axial movement back and forth through the container to either extend or retract under operator control an end-most length of the rod for being exposed through an open end of the container for dispensing therethrough. The container includes inner and outer tubular members mounted about a common longitudinal axis, the rod being mounted in the inner tubular member for the axial movement therethrough and the outer tubular member being mounted around the radially outward side of the inner tubular member. The improvement comprises the outer tubular member aditionally being movable axially with respect to the inner tubular member to enable adjustment of the container length in an axial direction to further selectively extend or retract an additional portion of the length of the rod from the opening.

9 Claims, 3 Drawing Sheets

COSMETIC CONTAINER

FIELD OF THE INVENTION

The present invention relates to cosmetic containers for solid cosmetics such as lipstick. In particular, an improved cosmetic container is provided that enables a user to efficiently protect an endmost length of lipstick that may have been originally left exposed for display purposes at the point of sale.

BACKGROUND OF THE INVENTION

Propel-repel type containers for dispensing solid cosmetics or like substances usually in the form of a rod or column such as a lipstick are well known in the art. A carrier holding the lipstick is selectively propelled or repelled longitudinally or axially along a common central axis by cooperating cam slots or grooves on relatively rotatable inner and outer tubular members by applying a swivel torque to said members about the central axis. The longitudinally projected or retracted position of the carrier is determined in accordance with the direction and extent of the relative rotation of the tubular members. Laterally extending notches on the inner tubular member cam slot defines retracted-most and projected-most positions for the lipstick at opposite limits of travel for the carrier. The container has an open end corresponding to open ends of the inner and outer tubular members through which the lipstick is exposed. A closure cap may be inserted in a telescoping manner over said tubular members at said open end and frictionally retained thereon to seal off said container. See e.g. U.S. Pat. Nos. 2,797,802; 2,840,229; 2,999,585; 3,083,822; 3,335,853; and 4,166,707.

In a typical application, the container is filled with a lipstick and a tip portion of the lipstick is left exposed at the open end beyond both tubular members for point of purchase display to show color, even though the carrier is in the retracted-most position. After purchase, the customer or user may wish to protect the displayed tip portion against damage or accidental smearing. However, sliding the closure cap over the open end may be difficult and messy if a substantial length of lipstick is left exposed. And if the closure cap is of a transparent material, the potential smudging of the cap during the cap insertion step may result in an unattractive and undesirable appearance.

SUMMARY OF THE PRESENT INVENTION

In accordance with the present invention, a conventional cosmetic container of the repel-propel type for solid cosmetics such as a lipstick is provided with the improvement wherein the outer tubular member is movable axially forward along a central axis in a telescoping manner when the carrier is in the retracted-most position to thereby further extend the outer member around an exposed length of the lipstick and protect the lipstick from damage or accidental smearing.

In a preferred embodiment of the present invention, the outer tubular member is mounted on the inner tubular member not only for relative rotation about said central axis, but also for relative translation axially or longitudinally of said axis. Said outer tubular member has an additional cam groove portion extending in the retracted-most direction, and said outer tubular member is propellable forwardly in a telescoping manner to effectively increase the length of said container and enclose an additional length of lipstick in response to continued relative rotation beyond the carrier's return to its retracted-most position.

It is an object of the present invention to provide an improved cosmetic container for efficiently protecting an endmost length portion of a column of solid cosmetic against damage and smearing.

It is a further object of the present invention to provide an improved cosmetic container wherein the placement of the closure cap thereon around an exposed lipstick is facilitated.

Further objects and advantages of the present invention will become apparent from the following description of the drawings and the preferred embodiments.

DETAILED DESCRIPTION OF THE PREFERRED EMBODIMENT

Figure 1:
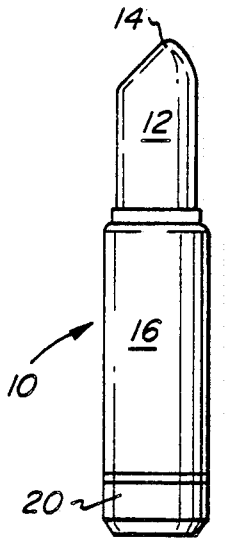
FIGS. 1, 1A, and 1B are side views of the improved cosmetic dispenser of the present invention in three different states of use.
Figure 1A:
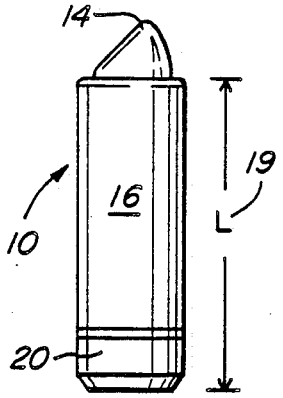
Figure 1B:
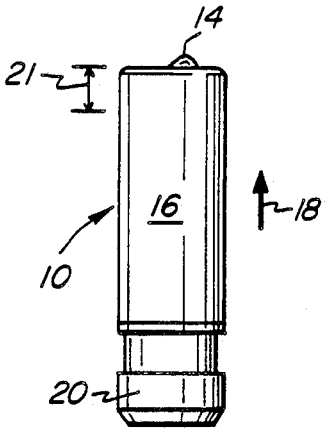

FIGS. 1, 1A, and 1B show the improved cosmetic propel-repel dispenser 10 of the present invention in three different conditions: FIG. 1 is for filling or insertion of lipstick 12 with the elevator cup or carrier all the way in the extended-most position (see FIG. 4 and description below); FIG. 1A is for display at point of purchase with the carrier all the way in the retracted-most position but the lipstick tip or endmost portion 14 still exposed to show color (see FIG. 5 and description below); and FIG. 1B is for further protection of tip 14 with outer sleeve 16 now propelled upwards in the direction of arrow 18 to increase the length L at 19 of the container by the distance indicated at 21 to thereby enclose most if not all of tip 14 (see FIG. 6 and description below).

The condition of dispenser 10 in FIG. 1B is achieved by the purchaser rotating element 20 relative to sleeve 16 to propel sleeve 16 upwards as further described below. The condition of FIG. 1B permits tip 14 to be further protected for storage, such as for example when putting a closure cap in place (see FIG. 2A and description below).

Figure 2:
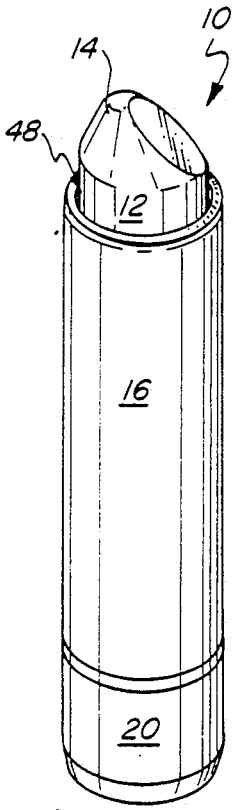
FIGS. 2 and 2A are perspective views, both assembled and exploded, of the dispenser of FIGS. 1, 1A, and 1B.
Figure 2A:
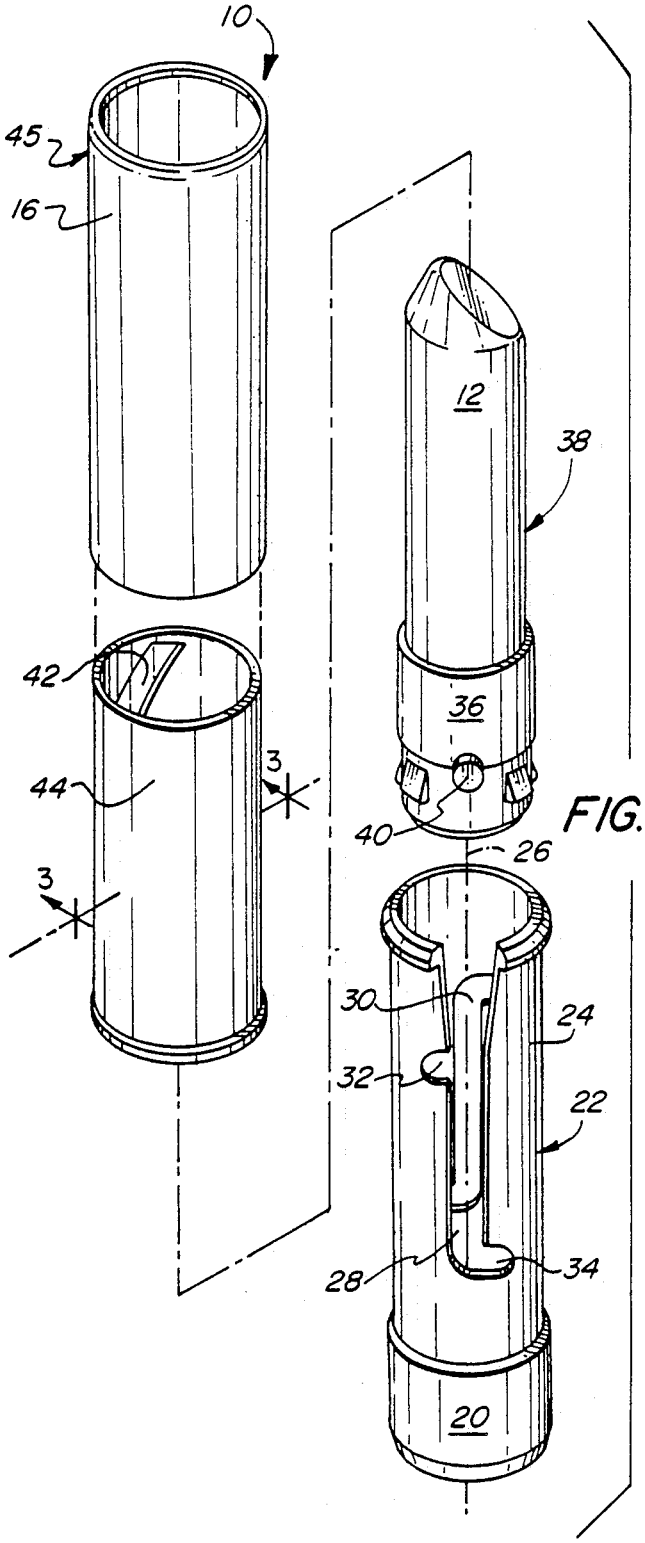

FIGS. 2 and 2A show the details of construction of the dispenser 10 of the present invention, which is of a conventional propel-repel type construction, but with an extended thread portion for the sleeve 16 that imparts its telescopic action as further described below. Innerbody 22 is a hollow, cylindrical, tubular member 24 having element 20 at one end thereof for grasping in order to apply a swivel torque to rotate member 24 about central axis 26 extending longitudinally of member 24. Member 24 is preferably formed of a polymeric material such as for example a thermoplastic like polystyrene. Member 24 has a pair of substantially straight cam slots 28 and 30 on diametrically opposite sides of member 24 with laterally extending notches or lock positions such as 32 and 34 shown for slot 28.

A carrier such as elevator cup 36 holds rod 38 of lipstick 12 for axial movement back and forth through member 24 while lug 40 travels in cam slot 28 and extends therethrough to engage helical cam groove 42 on a cam sleeve such as outer tubular member 44 also formed of a suitable polymeric material and mounted coaxially with and on the radially outward side of member 24.

An exterior sleeve 45 preferably of a suitably aesthetic appearance is affixed to cam sleeve 44 as shown by conventional means as for example gluing. Sleeve 45 has a suitable length for enclosing lipstick rod 38 as shown.

The manner in which lug 40 engages slot 28 and groove 42 in cam-follower tracking engagement to travel up and down axially of member 24 as cam sleeve 44 is rotated about axis 26 relative to innerbody 22 to extend or retract lipstick 12 through open end 48 of container 10 is well known in the art and need not be elaborated upon further here.

Figure 3:
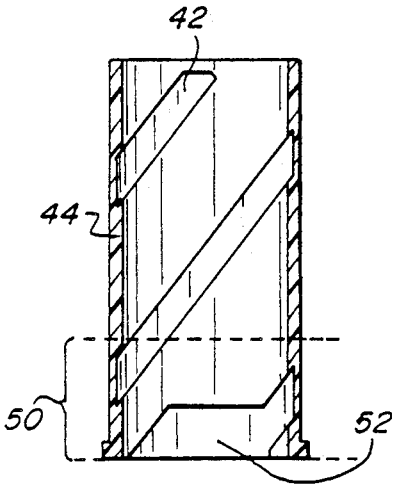
FIG. 3 is a cross-sectional view of the cam sleeve of the dispenser of FIGS. 1, 1A, and 1B.

In accordance with the present invention, cam sleeve 44 is further mounted for axial movement or translation back and forth along axis 26. Cam sleeve 44 has an additional threaded portion indicated generally at 50 in FIG. 3 that enables cam sleeve 44 to be propelled axially of member 24 in a telescoping manner. A flat locking portion such as circumferentially or laterally extending thread portion 52 is also provided.

Figure 4:
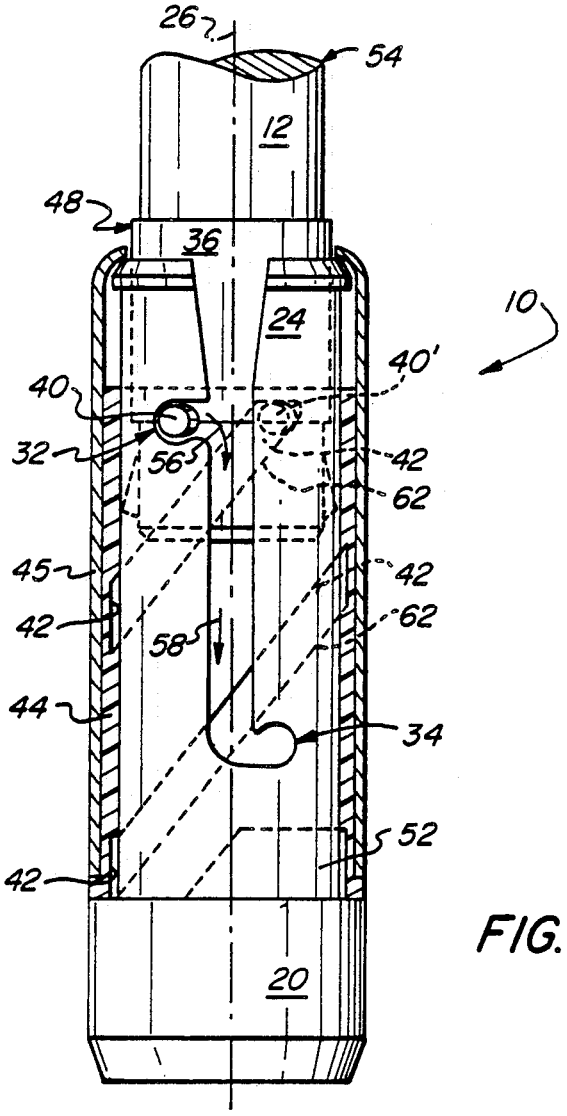
FIG. 4 is a side view with partial cutaway of the dispenser in the state shown in FIG. 1.

FIG. 4 shows container 10 with elevator cup 36 in the extended-most and locked position with lug 40 in notch 32. Lipstick 12 has been truncated as indicated by break lines 54 merely for ease of illustration. Arrows 56 and 58 illustrate the path that lug 40 and hence cup 36 will follow as cam sleeve 44 is rotated about common central axis 26 with respect to element 20 in response to a swivel torque.

Dotted slanted lines indicated generally at 62 show the helical cam groove 42 on that portion of the groove hidden from view by member 24 after the cutaway of cam sleeve 44 was performed.

Figure 5:
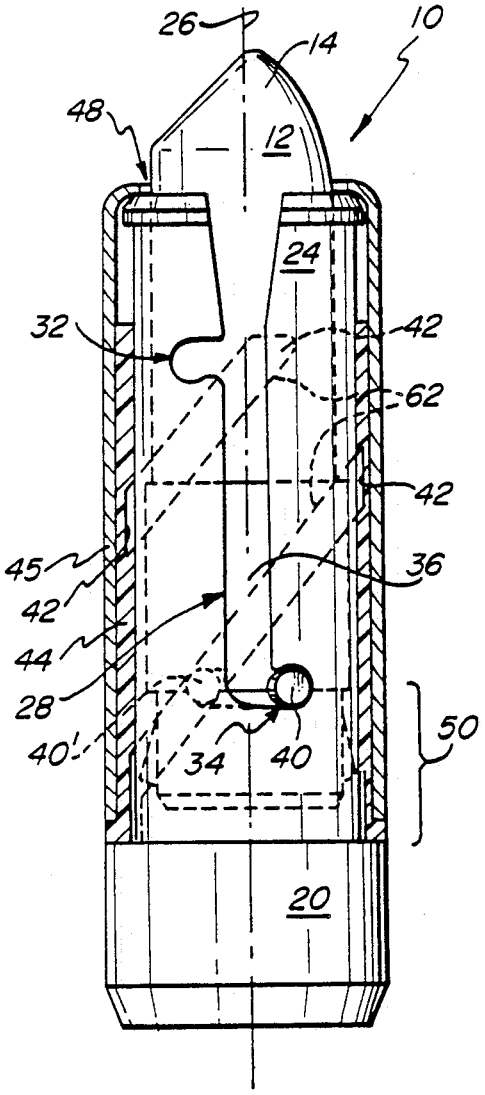
FIG. 5 is a side view with partial cutaway of the dispenser in the state shown in FIG. 1A.

In FIG. 5, lug 40 and hence cup 36 have moved to their retracted-most position by rotating element 20 relative to cam sleeve 44 and locked therein by notch 34. However, tip portion 14 of lipstick 12 is still exposed, as would for example be desirable to show the color of lipstick 12 in a blister pack at a point of purchase.

Figure 6:
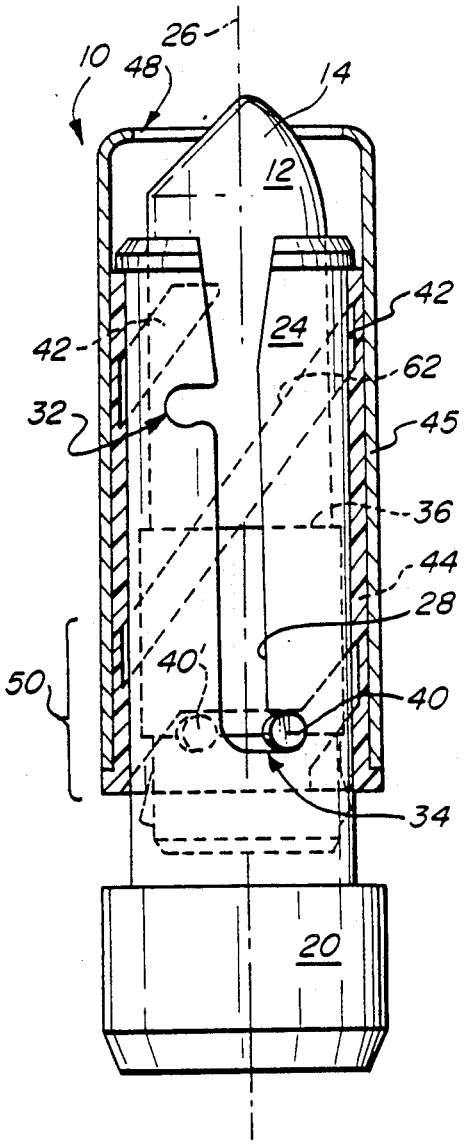
FIG. 6 is a side view with partial cutaway of the dispenser in the state shown in FIG. 1B.

FIG. 6 demonstrates the effect of the present invention when relative rotation between element 20 and cam sleeve 44 is continued after cup 36 reaches its retracted-most position. Cup 36 cannot be further retracted, because lugs 40, 40' have bottomed out in locking notch such as 34. Therefore, cam sleeve 44 begins to ride up and propel upward or forward on thread portion 50 which extends below lugs 40, 40' even in the retracted-most position. In the propelled forward position as illustrated at FIG. 6, tip 14 is mostly enclosed. If a closure cap (not shown) were to be placed around open end 48 of container 10, having tip 14 so withdrawn facilitates the slipping on of such cap.

It can also be appreciated that cam sleeve 44 is propellable or repellable at other points along the path of travel of cup 36 by having thread portion 50 act on lugs 40, 40'. That is, the telescopic motion of cam sleeve 44 can be accomplished in either a propel or repel direction at any point other than the extreme endmost points simply by grasping the cam sleeve 44 in a loose fashion and permitting the cam sleeve 44 to react and ride either up or down on the elevator cup lugs 40, 40' in response to the swivel torque rather than have the elevator cup 36 move along the innerbody.

It should be further understood that terms like "up", "down", and "forward" are terms indicated to show relative motion only and are not intended to be limiting of the present invention in any way.

It should be understood that various changes and modifications to the preferred embodiments described above will be apparent to those skilled in the art. Such changes and modifications can be made without departing from the spirit and scope of the present invention, and it is therefore intended that such changes and modifications be covered by the following claims.

I claim:

1. A cosmetic dispenser, comprising:

a tubular inner body having upper and lower ends and a wall, said inner body being provided with a longitudinal track extending through the wall of said inner body along a substantial length of said inner body, said longitudinal track having a lower end;

means for grasping and applying torque to said lower end of said inner body;

a tubular cam sleeve slidably and closely fitted over said inner body, said cam sleeve having upper and lower ends, and an internal helical track extending along a substantial length of said cam sleeve, said helical track having an upper terminus and a lower terminus, said cam sleeve helical track lower terminus extending below said inner body longitudinal track lower end when said cam sleeve is in a retracted position;

stop means for stopping said lower end of said cam sleeve in its retracted position;

an elevator cup for receiving a cosmetic stick material, said elevator cup being fitted inside said inner body, said elevator cup being provided with a radially outwardly extending lug, said lug being sized to fit into and engaging said longitudinal track of said inner body and said helical track of said cam sleeve for axial movement of said elevator cup by relative rotation of said cam sleeve and inner body;

whereby relative rotation of said cam sleeve and said inner body in one direction causes said cam sleeve to move to abut said stop means to be held in its retracted position and causes said elevator cup to be propelled upwardly in said inner body to a maximum extension, and relative rotation of said cam sleeve and said inner body in an opposite direction causes said elevator cup to be retracted into said inner body to a maximum retraction when said lug travels to said lower end of said inner body longitudinal track and causes said cam sleeve to be propelled upwardly relative to said inner body to an extended position as said lug travels to said lower terminus of said helical track.

2. A cosmetic dispenser in accordance with claim 1, wherein the lower terminus of said helical track includes a laterally extending portion for locking said cam sleeve in its extended position.

3. A cosmetic dispenser in accordance with claim 1 wherein said longitudinal track further comprises: a lower lateral notch located at the lower end of said longitudinal track; and an upper lateral notch located on said longitudinal track above said lower notch at a position corresponding to the maximum extension of said elevator cup.

4. A cosmetic dispenser in accordance with claim 1, wherein said means for grasping and applying torque to said inner body and said stop means comprise a knob having a diameter larger than an inner diameter of said cam sleeve integrally formed on the lower end of said inner body below the lower end of said cam sleeve.

5. A cosmetic dispenser in accordance with claim 1, further comprising a tubular outer sleeve for receiving said cam sleeve and affixed thereto.

6. A cosmetic dispenser in accordance with claim 5, further comprising a radially outwardly extending lip located at the upper end of said inner body, and wherein said cam sleeve has length shorter than the length of said inner body, and said outer sleeve has a length greater than the length of said cam sleeve and an inner diameter greater than an outer diameter of said lip, whereby said cam sleeve may be propelled upwardly until the upper end of said cam sleeve abuts said lip, and said outer sleeve extends above said lip.

7. A cosmetic dispenser, comprising:

a tubular inner body having upper and lower ends, a length, an outer diameter, and a wall, said inner body being provided with a longitudinal track extending through the wall of said inner body along a substantial length of said inner body, said longitudinal track having a lower end, said inner body having a radially outwardly extending lip having an outer diameter and being located at the upper end of said inner body, and a knob at the lower end of said inner body, said knob having a diameter greater than the outer diameter of said inner body;

a tubular cam sleeve slidably and closely fitted over said inner body, said cam sleeve having upper and lower ends, and an internal helical track extending along a substantial length of said cam sleeve, said helical track having an upper terminus and a lower terminus, said cam sleeve helical track lower terminus extending below said inner body longitudinal track lower end when said cam sleeve is in a retracted position, said cam sleeve having a length shorter than the length of said inner body;

a tubular outer sleeve for receiving said cam sleeve and affixed thereto, said outer sleeve having a length greater than the length of said cam sleeve and an inner diameter greater than the outer diameter of said inner body lip;

an elevator cup for receiving a cosmetic stick material, said elevator cup being fitted inside said inner body, said elevator cup being provided with a radially outwardly extending lug, said lug being sized to fit into and engaging said longitudinal track of said inner body and said helical track of said cam sleeve for axial movement of said elevator cup by relative rotation of said cam sleeve and inner body;

whereby relative rotation of said cam sleeve and said inner body in one direction causes said lower end of said cam sleeve to move to abut said knob to be held in its retracted position, and causes said elevator cup to be propelled upwardly in said inner body to a maximum extension, and relative rotation of said cam sleeve and said inner body in an opposite direction causes said elevator cup to be retracted into said inner body to a maximum retraction when said lug travels to said lower end of said inner body longitudinal track and causes said end sleeve to be propelled upwardly relative to said inner body until the upper end of said cam sleeve abuts said lip and said outer sleeve extends above said lip in a maximum extended position.

8. A cosmetic dispenser in accordance with claim 7, wherein the lower terminus of said helical track includes a laterally extending portion for locking said cam sleeve in its extended position.

9. A cosmetic dispenser in accordance with claim 8 wherein said longitudinal track further comprises: a lower lateral notch located at the lower end of said longitudinal track; and an upper lateral notch located on said longitudinal track above said lower notch at a position corresponding to the maximum extension of said elevator cup.

* * * * *